US008277117B2

(12) United States Patent
Verardo et al.

(10) Patent No.: US 8,277,117 B2
(45) Date of Patent: Oct. 2, 2012

(54) RADIAL CLAMPING SYSTEM FOR A TIMEPIECE COMPONENT

(75) Inventors: Marco Verardo, Les Bois (CH); Thierry Conus, Lengnau (CH); Jean-Philippe Thiebaud, Cudrefin (CH); Jean-Bernard Peters, Pieterlen (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 181 days.

(21) Appl. No.: 12/725,682

(22) Filed: Mar. 17, 2010

(65) Prior Publication Data

US 2010/0238772 A1 Sep. 23, 2010

(30) Foreign Application Priority Data

Mar. 17, 2009 (EP) ..... 09155376

(51) Int. Cl.
*G04B 29/00* (2006.01)

(52) U.S. Cl. ..... 368/321; 368/320

(58) Field of Classification Search ..... 368/320–324
See application file for complete search history.

(56) References Cited

U.S. PATENT DOCUMENTS

| | | | | |
|---|---|---|---|---|
| 173,011 | A * | 2/1876 | Hunter et al. | 368/323 |
| 3,397,531 | A * | 8/1968 | Dubois | 368/324 |
| 3,785,141 | A * | 1/1974 | Ikegami | 368/21 |
| 3,837,161 | A * | 9/1974 | Wuthrich | 368/22 |
| 7,438,465 | B2 | 10/2008 | Bitterli et al. | |
| 7,651,259 | B2 * | 1/2010 | Carrard et al. | 368/319 |
| 2006/0055097 | A1 | 3/2006 | Conus et al. | |
| 2008/0113154 | A1 | 5/2008 | Bitterli et al. | |

FOREIGN PATENT DOCUMENTS

| | | |
|---|---|---|
| CH | 282774 | 8/1952 |
| DE | 29 40 223 A1 | 4/1981 |
| EP | 0 419 421 A1 | 3/1991 |
| EP | 1 445 670 A1 | 8/2004 |
| EP | 1 850 193 | 10/2007 |
| EP | 1 921 518 A1 | 5/2008 |
| FR | 382 860 | 2/1908 |
| JP | 57-161680 | 10/1982 |

OTHER PUBLICATIONS

European search report issued in corresponding application No. EP 09155376, completed Sep. 11, 2009.

* cited by examiner

*Primary Examiner* — Sean Kayes
(74) *Attorney, Agent, or Firm* — Griffin & Szipl, P.C.

(57) ABSTRACT

The invention relates to a timepiece component (1) that has an aperture (7) for receiving a support element (3) and includes a clamping system (13) for exerting radial force, allowing said timepiece component to be secured to said support element. According to the invention, the clamping system (13) includes a radial clamping device (15) that has a crown (6) for exerting said radial force and a concentric, blind recess (8) spaced apart from said aperture, for allowing said crown to travel.

The invention concerns the field of timepieces.

8 Claims, 1 Drawing Sheet

RADIAL CLAMPING SYSTEM FOR A TIMEPIECE COMPONENT

This application claims priority from European Patent Application No. 09155376.8 filed Mar. 17, 2009, the entire disclosure of which is incorporated herein by reference.

FIELD OF THE INVENTION

The invention relates to a radial clamping system for a timepiece component and, more specifically, a system of this type for securing said component to a support element, such as, for example, a pivoting arbour.

BACKGROUND OF THE INVENTION

It is known to secure timepiece wheel sets by driving the central through hole in said wheel sets onto a pivoting arbour between a bridge and the bottom plate. This configuration is very widely used with metal materials. However, it cannot be applied to brittle materials, whose plastic deformation zone is virtually non-existent.

SUMMARY OF THE INVENTION

It is an object of the present invention to overcome all or part of the aforecited drawbacks by proposing a timepiece component, whose radial clamping system exclusively uses the elastic deformation zone of the material to secure itself to its support element.

The invention therefore relates to a timepiece component that has an aperture for receiving a support element and a clamping system that exerts radial force, enabling said timepiece component to be secured to said support element. The timepiece component is characterized in that the clamping system includes a radial clamping device that has a crown for exerting said radial force and a concentric, blind recess spaced apart from said aperture, to allow said crown to travel.

According to other advantageous features of the invention:

- said crown is notched to form several independent strips around said aperture;
- the inner section of the crown is truncated to increase said radial force locally;
- said section is smaller at the free end of the crown to exert maximum radial force against said support element at the free end of each strip;
- the clamping system further includes a locking system for ensuring that said clamping system maintains a minimum amount of force against said support element;
- the locking system includes a locking key comprising a collar for cooperating with said blind recess to limit the clearance of the free end of the crown;
- the inner section of the collar is truncated so that said locking is achieved progressively;
- the timepiece component is of generally discoid shape and it has a circumferential toothing to form a wheel set.

The invention also relates to a timepiece, characterized in that it includes at least one timepiece component according to any of the preceding variants.

BRIEF DESCRIPTION OF THE DRAWINGS

Other features and advantages will appear more clearly from the following description, given by way of non-limiting example, with reference to the annexed drawings, in which.

DETAILED DESCRIPTION OF PREFERRED EMBODIMENTS

As illustrated in FIGS. 1 to 4, the invention relates to a timepiece component, generally referenced 1, for cooperating with a support element 3. In the example used below, timepiece component 1 is an approximately discoid wheel set and support element 3 is a cylindrical arbour of circular section. However, they are not limited to these forms.

Figure 1:
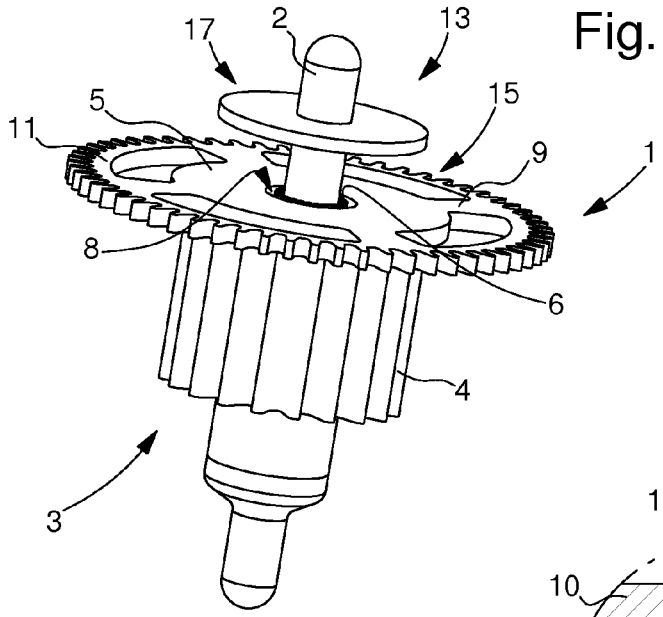
FIG. 1 is a perspective diagram of a timepiece component mounted on a support element in accordance with the invention.

The example visible in FIG. 1 shows a timepiece component 1, mounted on a support element 3. Support element 3 preferably includes an arbour 2 integral with a pinion 4. Timepiece component 1 has a hub 5 with an aperture 7, four arms 9 and a toothed felloe 11. Advantageously according to the invention, timepiece component 1 is mounted on support element 3 by means of a clamping system 13, located around aperture 7, which passes through said component.

Clamping system 13 is for exerting radial force on arbour 2 to secure timepiece component 1 to support element 3. Clamping system 13 is an alternative to a driving-in system, which is not always possible for materials such as crystallised silicon, silicon carbide, crystallised silica or crystallised alumina.

Clamping system 13 preferably includes a radial clamping device 15 and a locking device 17. The clamping device 15 mainly includes a crown 6 and a recess 8. Crown 6 is for clamping the external surface of arbour 2. It is preferably notched and has several strips 12, whose inner section 14 forms the edge of aperture 7, to control the travel of crown 6 better locally. Thus, advantageously according to the invention, each strip 12 is independent and moves elastically depending upon the actual force that is applied thereto.

Figure 3:
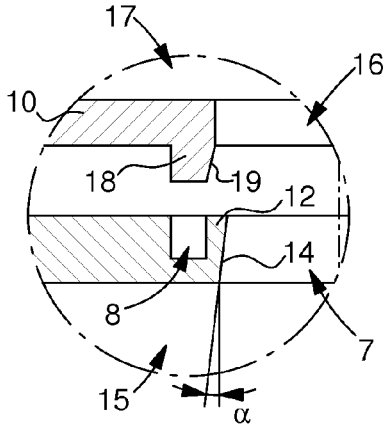
FIG. 3 is an enlarged diagram of one part of FIG. 2.
Figure 2:
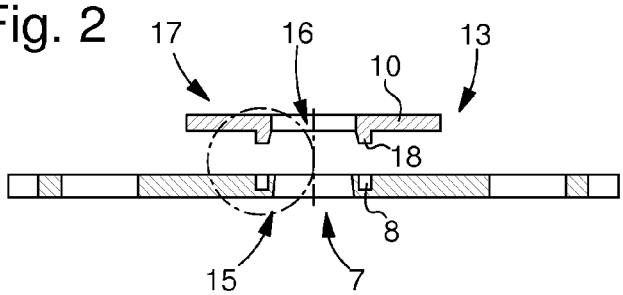
FIG. 2 is a section of a timepiece component according to the invention.
Figure 4:
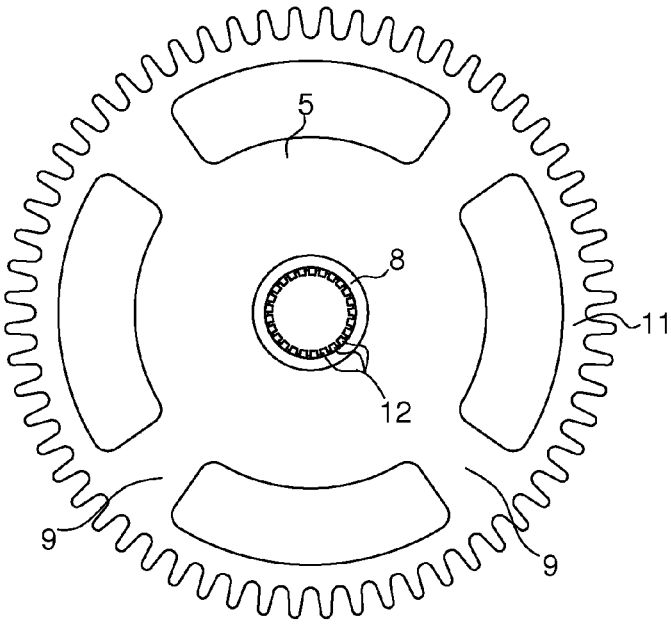
FIG. 4 is a top view of a timepiece component in accordance with the invention.

As FIG. 3 shows, inner section 14 is truncated at an angle $\alpha$, to increase the clamping force locally. In the example illustrated in FIGS. 1 to 4, the top section of aperture 7 is thus smaller than the bottom section. According to the invention, angle $\alpha$ can be between approximately 0 and 5 degrees. It is thus clear that the clamping force of crown 6 of clamping device 15 will be at a maximum at the free end thereof, i.e. at the end of strips 12.

Recess 8 is for allowing a travel for crown 6. According to the invention, recess 8 is preferably a blind recess and communicates, between each strip 12, with aperture 7. Each strip 12 can thus move from side to side independently between recess 8 and aperture 7. Preferably, according to the invention, recess 8 also cooperates with locking device 17.

According to the invention, depending upon the application of the timepiece component, the depth of the recess 8 can be between 5 and 85% of the thickness of the timepiece component.

Locking device 17 is for ensuring that clamping system 13 maintains a minimum amount of force against arbour 2 by limiting the side to side movements of strips 12 when the overall positioning is deemed satisfactory. Thus, locking device 17 has an approximately discoid locking key 10 that has a hole 16 and, on the bottom surface thereof, a collar 18.

Hole 16 is preferably a through hole whose inner section is larger than the external diameter of arbour 2, so that the arbour can slide therein without any push fit. Collar 18 is of generally annular shape and the inner section 19 thereof is approximately truncated so that strips 12 are locked in position progressively.

Consequently, with reference to FIG. 3, it is clear that locking key 10 slides against arbour 2 through hole 16, so that collar 18 is received in recess 8. Once inserted, collar 18 thus prevents any movement by strips 12 towards recess 8, by locking them in position, abutting against inner section 19.

Timepiece component 1 is preferably made of micro-machinable material, so that precision of less than a micron can be achieved. These materials may be, for example, but not exclusively, silicon carbide, crystallised silicon, crystallised alumina or crystallised silica. The materials can be etched depending upon the required precision, particularly by means of a deep reactive ion etching technique (DRIE). Moreover, locking key 10 is preferably formed of a ductile material, such as, for example, a metal.

Of course, the present invention is not limited to the illustrated example, but is capable of various variants and alterations, which will be clear to those skilled in the art. In particular, depending upon the applications envisaged and/or the material used, the dimensions of recess 8 and collar 18 may differ, as may their respective distance relative to aperture 7.

What is claimed is:

1. A timepiece component that has an aperture for receiving a support element and includes a clamping system for exerting radial force to secure said timepiece component to said support element, wherein the clamping system has a radial clamping device that includes a crown for exerting said radial force and a concentric, blind recess, spaced apart from said aperture, for allowing said crown to travel, and wherein the clamping system also has a locking device that includes a locking key, provided with a collar for cooperating with said blind recess to limit the travel of the free end of the crown, wherein the key is a circular disc having a concentric opening configured to have the support element pass therethrough, the opening being concentric with an aperture formed in the timepiece component.

2. The timepiece component according to claim 1, wherein said crown is notched to form several independent strips around said aperture.

3. The timepiece component according to claim 2, wherein an inner section of the crown is truncated to increase said radial force locally.

4. The timepiece component according to claim 3, wherein said inner section is smaller at a free end of the crown to exert a maximum amount of radial force against said support element at the free end of each strip.

5. The timepiece component according to claim 1, wherein inner section of the collar is truncated so that the radial force increases progressively during clamping.

6. A timepiece, wherein the timepiece includes at least one timepiece component according to claim 1.

7. The timepiece component according to claim 1, wherein the support element has an axis; the collar is configured to extend in a direction essentially parallel with the axis of the support element; and wherein an inboard edge of the collar is truncated.

8. A timepiece component that has an aperture for receiving a support element and includes a clamping system for exerting radial force to secure said timepiece component to said support element, wherein the clamping system has a radial clamping device that includes a crown for exerting said radial force and a concentric, blind recess, spaced apart from said aperture, for allowing said crown to travel, and wherein the clamping system also has a locking device that includes a locking key, provided with a collar for cooperating with said blind recess to limit the travel of the free end of the crown, wherein the timepiece component is of generally discoid shape and has a circumferential toothing to form a wheel set, and wherein the key is a circular disc and is configured to lie flat on the generally discoid shaped time piece component when the collar enters the blind recess.

* * * * *